United States Patent [19]

Pansanel

[11] Patent Number: 4,519,133

[45] Date of Patent: May 28, 1985

[54] METHOD OF, AND APPARATUS FOR, TERMINATING A CONDUCTOR OF A FLAT FLEXIBLE CABLE

[75] Inventor: Jean C. Pansanel, Herblay, France

[73] Assignee: AMP Incorporated, Harrisburg, Pa.

[21] Appl. No.: 508,954

[22] Filed: Jun. 29, 1983

[30] Foreign Application Priority Data

Jul. 15, 1982 [FR] France ..... 82 12385

[51] Int. Cl.[3] ..... H01R 4/16

[52] U.S. Cl. ..... 29/863; 339/75 MP; 339/176 MF

[58] Field of Search ..... 339/17 F, 176 MF, 176 MP, 339/75 MP; 29/863, 865, 866, 867

[56] References Cited

U.S. PATENT DOCUMENTS

| | | | |
|---|---|---|---|
| 3,753,211 | 8/1973 | Pauza et al. | 339/75 MP |
| 3,989,336 | 11/1976 | Rizzio, Jr. et al. | 339/176 MF |
| 4,021,091 | 5/1977 | Anhalt et al. | 339/176 MP |
| 4,181,386 | 1/1980 | Olsson | 339/17 F |
| 4,252,392 | 2/1981 | Whiteman | 339/74 R |
| 4,252,393 | 2/1981 | Johnson | 339/75 MP |
| 4,334,728 | 6/1982 | Reynolds et al. | 339/74 R |
| 4,379,608 | 4/1983 | Olsson et al. | 339/75 MP |

FOREIGN PATENT DOCUMENTS

| | | | |
|---|---|---|---|
| 2508717 | 12/1982 | France | 339/74 R |

*Primary Examiner*—John McQuade

*Attorney, Agent, or Firm*—Katherine A. Nelson

[57] ABSTRACT

In a method of, and apparatus for, terminating a conductor of a flat flexible cable, a flat flexible cable is inserted into a U-shaped terminal having a resiliently deflectable arm. A camming element is then inserted into the terminal to urge the cable against a contact surface of the deflectable arm, the cable having been previously stripped of insulation on its side adjacent to the contact surface. The deflectable arm is first elastically deflected by the action of the camming element and is thereafter plastically deflected thereby. The camming element is so dimensioned, and the resistance of the flexible arm to its plastic deflection in relation to its resistance to its elastic deflection are such that, the final contact force exerted against the cable conductor is independent, for practical purposes, of the stripped thickness of the cable, such thickness not exceeding 0.4 mm.

8 Claims, 11 Drawing Figures

METHOD OF, AND APPARATUS FOR, TERMINATING A CONDUCTOR OF A FLAT FLEXIBLE CABLE

This invention relates to a method of, and apparatus for, terminating a conductor of a flat flexible cable. There is known from U.S. Pat. No. 3,333,229, a method of terminating a conductor of a flat flexible cable to an electrical terminal comprising a resiliently deflectable arm upstanding from a base portion of the terminal and having a contact surface remote from the base portion; in which method a camming element is inserted between the contact surface and an abutment opposite thereto and spaced therefrom, to urge the conductor against the contact surface and thereby elastically to deflect the arm away from the abutment.

There is also known from U.S. Pat. No. 3,333,229, an electrical connector comprising a one-piece electrical terminal having a pair of spaced arms upstanding in juxtaposed, spaced relationship from a base portion of the terminal, a housing receiving the terminal, and a camming element, which is insertable between the arms to urge a conductor of a flat flexible cable against one of the arms when the camming element has been fully inserted between the arms, the camming element being tapered in the direction of its insertion.

The invention is intended to provide such a method and connector, for flat flexible cables of the kind known as film cables; in which the contact force exerted against the cable conductor is, as far as is practicable, independent of the cable thickness. The contact force should be high enough to afford effective electrical contact between the conductor and the contact surface, but should not be so high that the conductor, which may be for example in the form of a band of electrically conductive ink, is damaged by the contact surface. Such ink conductors are used, for example, in the construction of electrical membrane switches.

In a method according to the invention the camming element is so dimensioned that following the elastic deflection of the arm, the arm is finally plastically deflected by movement of the contact surface away from the abutment by a distance at least equal to the thickness of the cable, the resistance of the arm to its plastic deflection once the elastic limit of the arm has been overcome being less that the resistance of the arm to its elastic deflection prior to said elastic limit being overcome, to an extent to render the final contact force exerted against the conductor sensibly independent (as defined below) of the cable thickness with the conductor exposed, which thickness does not exceed about 0.4 mm.

The final contact force is herein defined as being "sensibly independent of the cable thickness with the conductor exposed", when it increases by no more than 2 to 3.5N over the range of thickness concerned, namely 0 to about 0.4 mm.

In an electrical connector according to the invention the one arm has, at a position remote from the base portion, a bowed contact surface projecting towards the other arm which is restrained against movement away from the one arm, the thickness of the camming element, as seen in cross-section through the contact surface and the cable when the camming element has been fully inserted between the arms, being such that during the insertion of the camming element after the one arm has first been elastically deflected to move the contact surface away from the other arm, the one arm is plastically deflected in the same direction over a distance which is at least equal to the thickness of the cable with the conductor exposed; and in that $K2 < 0.30\ K1$, where K1 is the elastic characteristic of the terminal and K2 is its corresponding characteristic in respect of its plastic deformation.

Although it is known from (European patent application No., first publication with European Patent Office Search Report) EP-A1-38882, to make a connection between a conductor of a flat flexible film cable and spring contact by deforming an arm of the contact beyond its elastic limit, to engage the conductor, the contact is a U-shaped element which is deformed about the conductor, under pressure, by means of a crimping operation.

It is further known to employ a camming element in combination with a spring arm of an electrical terminal to make a connection with a conductor of an ordinary flat flexible cable, from U.S. Pat. No. 3,920,301 and Japanese utility model disclosure No. 55-10282, but in these cases, as well as in the case of U.S. Pat. No. 3,333,229 (cited above) no precise manner of regulating the final contact force is disclosed.

An embodiment of the invention will now be described by way of example with reference to the accompanying drawings in which.

Figure 1:
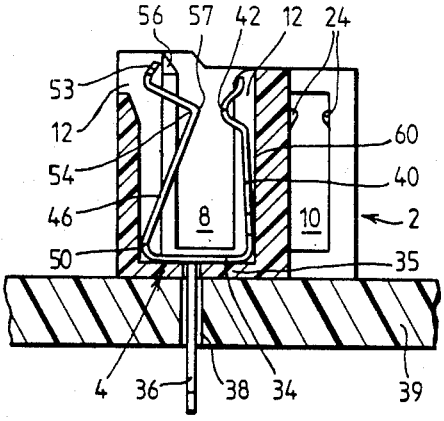
FIG. 1 is a sectional view of an electrical connector for terminating the conductors of a flat flexible film cable, mounted on a circuit board and prior to the assembly of a cam member to the housing of the connector.

The connector comprises an elongate insulating housing 2 (best seen in FIGS. 8 and 9); a plurality of electrical terminals 4 and an insulating cam member 6.

The housing 2 defines juxtaposed channels 8 and 10 extending longitudinally thereof. The channel 8 is subdivided transversely of the housing 2, by barriers 12 defining pockets each containing one of the terminals 4.

Figure 8:
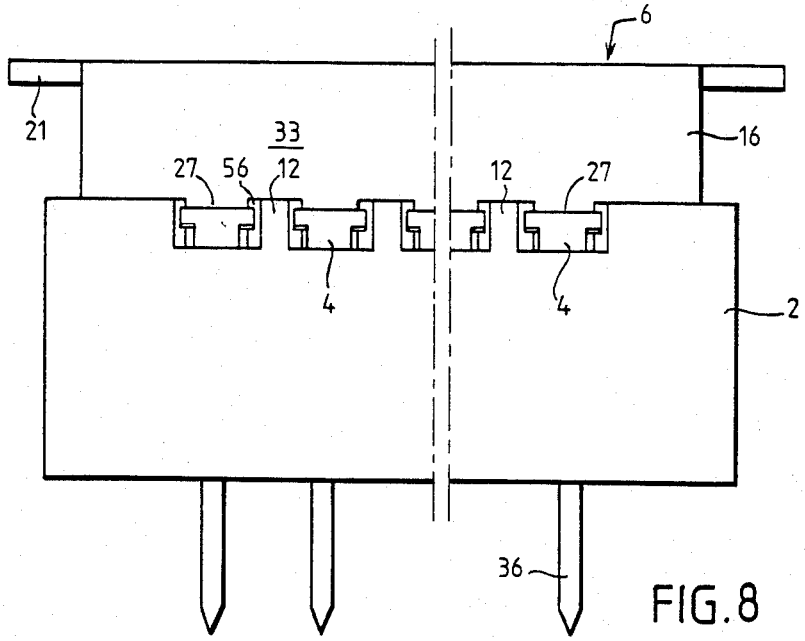
FIGS. 8 and 9 are, respectively, a side view and the end view, of the connector.
Figure 9:
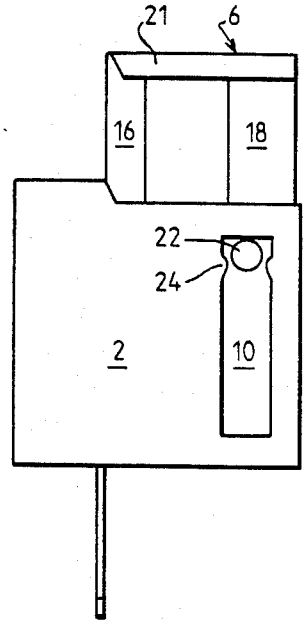

The cam member 6, which is substantially U-shaped as seen in FIGS. 3 to 5 and 9, has a camming element in the form of a camming leg 16 for reception in the pockets 14 along a rectilinear path "A" (FIG. 3), and a guide leg 18 for reception in the channel 10, these legs extending in the same direction and in parallel relationship from a central web 20 provided with handles 21 (FIGS. 8 and 9). The guide leg 18 carries, in the channel 10, ball detents 22 (one of which is shown) for co-operation with rounded protrusions 24 at either end of the housing 2. The camming leg 16 has tapered or wedge shaped end portions 27 with outer cam surfaces 28 which are inclined with respect to the path "A" and which are opposite to a rectilinear bearing surface 30 of the leg 16. The portions 27 terminate in inwardly inclined portions 32. Between the web 20 and the portions 27, the leg has a maximum thickness, constant cross-section, portion 33 having a conductor engaging surface 35'.

Figure 2:
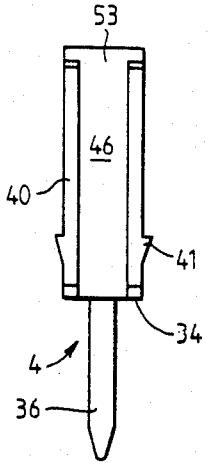
FIG. 2 is an enlarged end view of a terminal of the connector.

Each terminal 4, which has been stamped and formed from a single metal sheet, e.g. of phosphor bronze, comprises a base in the form of a flat web 34 resting upon the floor 35 of the channel 8, and from which extends, normally thereof, a connecting post 36 projecting through a hole in the floor 35 and through a hole 38 in a circuit board 39, the post 36 being connected e.g. by soldering, to a conductor (not shown) of the board 39. From one end of the web 34 upstands a first cantilever arm 40 having a rectilinear portion connected to the web 34 and terminating in a semi-circular bowed position 42 having an inwardly bowed surface 43. The arm 40 has spurs 41 (FIG. 2) for retaining the terminal in the housing 2.

From the opposite end of the web 34 upstands a second cantilever contact arm 46 spaced from, and in juxtaposed relationship with, the arm 40. The arm 46, which is of smaller width than the arm 40 (see FIG. 2), has a rectilinear portion connected at its lower end to the web 34 by a bight 50 and being connected at its upper end, by way of an inwardly bowed contact portion 54, to a hooked free end portion 52 having a cross-piece 53 which is engageable with stops 56 on adjacent barriers 12 between which the terminal 4 is disposed. The portion 54 has a bowed contact surface 57 projecting towards, and positioned substantially opposite to, the surface 43 of the arm 40.

As shown in FIG. 1, prior to the cam member 6 being assembled to the housing 2, the arm 40 diverges slightly from the adjacent wall 60 of the channel 8.

Figure 3:
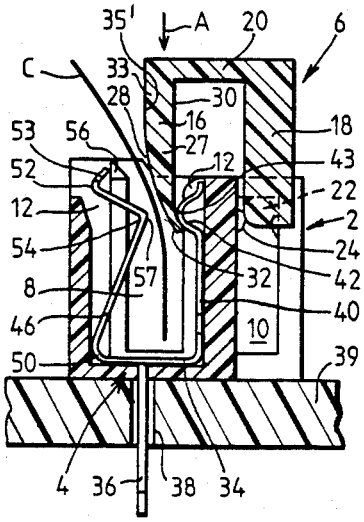
FIG. 3 is a view similar to FIG. 1 but showing the cam member assembled to the housing, in a starting position, and an end portion of a flat flexible film cable inserted into the connector.

The cam member 6 is assembled to the housing 2 as shown in FIG. 3, with the detents 22 resting on the protrusions 24, and the inclined portions 32 of the camming leg 16 in engagement with the surfaces 43 of the arms 40, whereby the arms 40 are resiliently deflected and pressed against the walls 60, whereby the surfaces 43 constitute fixed abutments.

Figure 4:
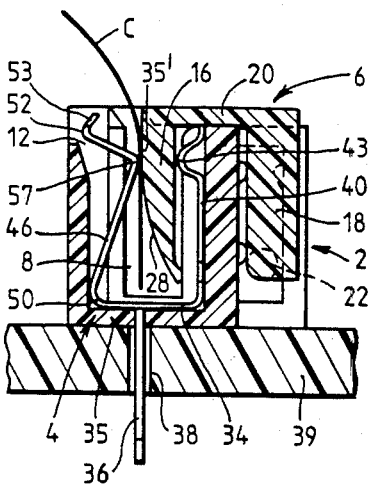
FIG. 4 is a similar view to FIG. 3 but showing the cam member in a pushed home position to terminate the cable.
Figure 5:
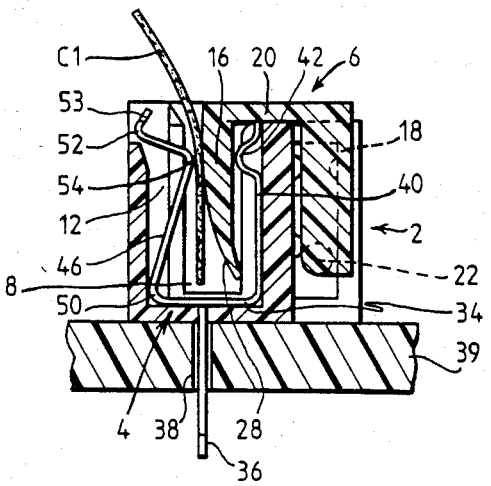
FIG. 5 is a similar view to FIG. 4 but showing a cable of greater thickness than that shown in FIG. 4, terminated in the connector.

The end portion of a flat flexible multi-conductor film cable C, which portion has been stripped of insulation to expose the cable conductors (not shown), at least on its left hand (as seen in FIGS. 3 to 5) side, is then inserted into the channel 8, between the surfaces 28 of the leg 16 and the contact surface 57 of each bowed contact portion 54, as shown in FIG. 3. By virtue of the stops 56 the surfaces 57 are always spaced from the surface 28.

In order to make secure electrical connection between each conductor of the cable C, and the corresponding terminal 4, the cam member 6 is pushed home along the path "A" into the housing 2, as shown in FIG. 4. After the detents 22 have passed over the protrusions 24, the leg 16 acts to press the conductors of the cable against the contact surfaces 57 in such a way that there is no further contact between the member 6 and the housing 2, the leg 18 having lateral play in the channel 10. As the cam member 6 is pushed home, the contact arms 46 are initially elastically deflected away from the arms 40 and are then finally plastically deflected away therefrom, about the bights 50. However, the terminals 4 have sufficient residual elasticity to ensure that a substantial final contact force is exerted against the cable conductors by the surfaces 35' and 57 (FIG. 4). The thickness of the portion 33 of the leg 16 is such that the plastic deflection of the arm 46 takes place whilst the surface 57 is moving away from the surface 43 at least by a distance equal to the thickness of the cable C. The cam member 6 is guided by virtue of the engagement of the surface 30 of the leg 16 against the surfaces 43.

The resistance to their plastic deflection, of the contact arms 46 once the elastic limit has been overcome, is substantially less than the resistance to their elastic deflection prior to said elastic limit being overcome so that the final contact force exerted against the conductors of the cable C is always sensibly independent (as defined below) of the thickness of the cable C where this is up to about 0.4 mm. FIG. 5 shows the connector when in use to make connection to the conductors of a cable C1 which is of substantially greater thickness than the cable C.

The cable C may be removed from the connector by withdrawing the cam member 6 to its initial position (which is determined by the engagement of the detents 22 behind the protrusions 24, and the engagement of the portions 32 of the leg 16 with the portions 42), and then pulling the cable C out from between surfaces 28 and 57. However, the connector can be used again only with a cable which is of no less thickness than the last cable that was used therewith.

The operation of a terminal 4 will now be described in more detail with reference to FIGS. 6 and 6A, and 7 and 7A.

Figure 6:
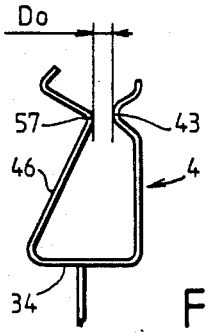
FIGS. 6, 6A and 7 are diagrammatic side views.
Figure 6A:
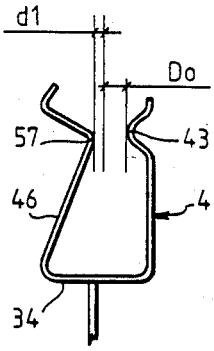
Figure 7:
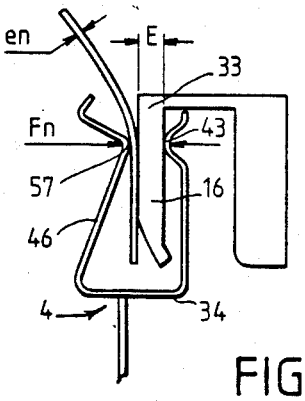
Figure 7A:
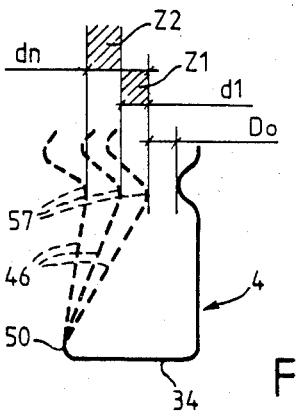
FIG. 7A is a schematic side view, of a terminal of the connector, illustrating operation thereof.

FIG. 6 shows the terminal 4 prior to the insertion of the leg 16 and the cable, between the surfaces 43 and 57, the initial minimum gap therebetween being indicated by Do. FIG. 6A shows the terminal when the arm 46 has been elastically deflected, but prior to its plastic deflection, the extent of the movement of the surface 57 being indicated by d1. FIG. 7 shows the leg 16 fully inserted between the surfaces 43 and 57, the width of the portion 33 of the leg 16 being indicated by E, the final contact force in respect of a cable of stripped thickness en being indicated by Fn. FIG. 7A illustrates schematically the deflection of the arm 46, by the leg 16 and the cable, the total extent of movement, in respect of a cable of stripped thickness en, of the surface 57 during both the elastic and the plastic deflection of the arm 46 being indicated by dn. The zone of elastic deflection is referenced Z1 and the zone of plastic deflection, Z2.

Given that the elastic characteristic of the terminal is K1, where the deflection d of the surface 57 is less than its deflection d1 through zone Z1, that the corresponding characteristic of the terminal in respect of the deflection of the surface 57 through zone Z2, where d exceeds d1, is K2, that $E-Do>d1$, that en does not exceed about 0.4 mm, and that $K2<0.30\ K1$ (approximately, in dependence upon the material of the terminal);

$$Fn=K1d1+K2(dn-d1)$$

$$dn=E-Do+en$$

$$Fn=K1d1+K2(E-Do+en-d1)$$

The variation in the final contact force Fn in respect of cable thickness is thus proportional to K2 which is substantially smaller than K1.

Although in practice, the final contact force Fn will increase from 2 to 3.5N ($2\times10^5$ to $3.5\times10^5$ dynes), over the range of cable thickness concerned (0 to about 0.40 mm), it has been found that such variation, which is linear, can readily be tolerated in practice so that the final contact force may be said to be "sensibly independent of the cable thickness".

In a specific example of the connector, the dimensions referred to above were as follows:

Fo=2N
K1=10,000N/m (measured)
K2=3,000N/m (measured)
d1=$0.2\times10^{-3}$ m (measured)
E=$0.8\times10^{-3}$ m (measured)
Do=$0.5\times10^{-3}$ m
en minimum=0
en maximum=$0.4\times10^{-3}$ m
F0=2N
F0.4=3.5N F0 being the final contact force when no cable is present between the leg 16 and the contact surface 57, and F0.4 being the final contact force when en is 0.40 mm.

I claim:

1. A method of terminating a conductor of a flat flexible film cable to an electrical terminal said terminal having a resiliently deflectable arm upstanding from a base portion of the terminal and a contact surface remote from the base portion; the method comprising the steps of:

inserting the conductor adjacent said terminal, inserting a camming element between the contact surface and an abutment opposite thereto and spaced therefrom, urging said conductor against the contact surface by means of said camming element and thereby elastically and plastically deflecting the arm by movement of the contact surface away from the abutment by a distance at least equal to the thickness of the cable, the resistance of the arm to its plastic deflection once the elastic limit of the arm has been overcome being less than the resistance to its elastic deflection, prior to said elastic limit being overcome, such deflection being to an extent to render the final contact force exerted against the conductor sensibly independent of the cable thickness with the conductor exposed, that is the final contact force increases by no more than 2 to 3.5N over the range of thickness concerned, which thickness does not exceed about "0.4 mm".

2. A method of terminating a conductor of a flat flexible film cable to an electrical terminal according to claim 1, wherein K2<0.31 K1; where K1 is the elastic characteristic of the terminal and K2 is the corresponding characteristic thereof in respect of the plastic deflection of the arm.

3. A method of terminating a conductor of a flat flexible film cable to an electrical terminal according to claim 2, wherein $Fn=K1d1+K2(dn-d1)$;

$dn=E-Do+en$; and therefore by substitution $Fn=K1d1+K2(E-Do+en-d1)$; where Fn is the contact force in respect of a cable of stripped thickness en, d1 is the distance through which the contact surface is moved away from the abutment during the elastic deflection of the arm, dn is the total distance through which the contact surface is moved away from the abutment in respect of a cable of stripped thickness en, E is the thickness of the camming element as seen in cross-section through the contact surface after the plastic deflection of the arm, and Do is the initial minimum distance between the contact surface and the abutment.

4. A method of terminating a conductor of a flat flexible film cable to an electrical terminal according to claim 3, wherein K1=10,000N/m, K2=3,000N/m, d1=$0.2\times10^{-3}$, E=$0.8\times10^{-3}$ m and Do=$0.5\times10^{-3}$ m and Fn is between 2N and 3.5N in dependence upon the value of en.

5. An electrical connector comprising a one-piece electrical terminal having a pair of spaced arms upstanding in juxtaposed, spaced relationship from a base portion of the terminal, and a camming element, which is insertable between the arms, to urge a conductor of a flat flexible cable against one of the arms when the camming element has been fully inserted between the arms, the camming element being tapered in the direction of its insertion; wherein the one arm has, at a position remote from the base portion, a bowed contact surface projecting towards the other arm which is restrained against movement away from the one arm, the thickness of the camming element, as seen in cross-section through the contact surface and the cable when the camming element has been fully inserted between the arms, being such that during the insertion of the camming element, after the one arm has first been elastically deflected to move the contact surface away from the other arm, the one arm is plastically deflected in the same direction over a distance which is at least equal to the thickness of the cable with the conductor exposed; and in that K2<0.30K1, where K1 is the elastic characteristic of the terminal and K2 is its corresponding characteristic in respect of its plastic deformation.

6. A connector according to claim 5, wherein the camming element is captive to a housing containing the terminal, and initially elastically deflects the other arm against a wall of the housing as the camming element is assembled to the housing.

7. A connector according to claim 5, wherein during the insertion of the camming element between the arms, the former initially urges the other arm resiliently against a wall of a housing containing the terminal; and in that the camming element, is mounted to the housing with play laterally of the insertion direction of the camming element.

8. A connector according to claim 5, 6 or 7 wherein the one arm which is in the form of a cantilever, is of constant cross-section between the base member and a crosspiece at the free end of the one arm.

* * * * *